US006266907B1

(12) United States Patent
Matteau et al.

(10) Patent No.: US 6,266,907 B1
(45) Date of Patent: Jul. 31, 2001

(54) ALBUM PAGE

(75) Inventors: Paul Raymond Matteau, Claremont, NH (US); John P. Jordan, Rehoboth; Paul Mylander, North Attleboro, both of MA (US)

(73) Assignee: Intercraft Company, Statesville, NC (US)

( * ) Notice: Subject to any disclaimer, the term of this patent is extended or adjusted under 35 U.S.C. 154(b) by 0 days.

(21) Appl. No.: 09/256,672

(22) Filed: Feb. 23, 1999

(51) Int. Cl.[7] ..... A47G 1/06

(52) U.S. Cl. ..... 40/776; 40/771; 428/137; 428/198

(58) Field of Search ..... 40/776, 771, 124.4; 428/133

(56) References Cited

U.S. PATENT DOCUMENTS

| | | | | |
|---|---|---|---|---|
| 1,676,492 | * | 7/1928 | Goodwin | 40/124.4 |
| 1,769,610 | * | 7/1930 | Vogel | 40/124.4 |
| 2,421,503 | | 6/1947 | Hermon . | |
| 3,587,187 | * | 6/1971 | Sibley | 40/776 |
| 3,596,393 | | 8/1971 | Lithgow . | |
| 3,651,591 | | 3/1972 | Woodyard | 40/776 X |
| 4,244,762 | | 1/1981 | Holson | 40/776 X |
| 4,356,649 | | 11/1982 | Diamond et al. . | |
| 4,405,228 | | 9/1983 | Muscoplat . | |
| 4,447,973 | | 5/1984 | Wihlke . | |
| 4,702,026 | * | 10/1987 | Shaine | 40/776 |
| 4,965,948 | | 10/1990 | Ruebens | 40/776 X |
| 5,301,445 | | 4/1994 | Hoffmeister | 40/776 X |
| 5,458,938 | * | 10/1995 | Nygard et al. | 428/137 X |

FOREIGN PATENT DOCUMENTS

| | | |
|---|---|---|
| 534428 | 6/1930 | (DE) . |
| 94 04 489 | 8/1994 | (DE) . |
| 0 619 193A1 | 1/1996 | (EP) . |
| 332929 | 6/1903 | (FR) . |
| 11790 | 6/1894 | (GB) . |
| 29275 | 12/1897 | (GB) . |
| WO 95 35218 | 12/1995 | (WO) . |

* cited by examiner

*Primary Examiner*—Joanne Silbermann
(74) *Attorney, Agent, or Firm*—Foley & Lardner

(57) ABSTRACT

An album page for displaying articles, such as photographs, includes an intermediate, preferably opaque, sheet and a pair of outer sheets made from a transparent plastic material. Die cuts are provided in the immediate sheet at a plurality of locations, and the two outer sheets are adhered to one another at the locations defined by the die cuts. The preferred album page does not use adhesives to bond either outer sheet to the intermediate sheet, and the die cut/seal areas are arranged to permit display of rectangular objects in either horizontal or vertical positions. The invention features an arrangement, which insures that horizontally displayed objects are supported on both sides of the bottom edge thereof to enhance the overall aesthetics of the filled page.

28 Claims, 3 Drawing Sheets

ALBUM PAGE

CROSS REFERENCES TO RELATED APPLICATIONS, IF ANY

None

BACKGROUND OF THE INVENTION

1. Field of the Invention

The present invention relates generally to album pages useful for the display of planar objects, and more particular, in the illustrated embodiments, to the display of photographs. In its most preferred embodiment, the present invention relates to an album page which may be used to display similarly sized objects, e.g. photographs, in either a vertical or a horizontal position, and when displayed horizontally, the page supports the photograph on both sides of its bottom edge to prevent skewing of the photograph.

2. Description of the Prior Art

A wide variety of pages or sheets used to support and display planar objects are known in the art. Such objects may be stamps, letters, art works, photographs, recipes or any of a wide variety of other objects. The size of the objects can also vary widely, so that the number of objects to be displayed per page or sheet can range from a single object to a large number of objects. Moreover, certain prior art album pages or display sheets have been designed for the display of different size objects on the same sheet and for various orientations thereof, and in some cases the display of a plurality of similarly sized objects in different orientations. Several examples of prior art pages and sheets will be described to provide the reader with additional background.

A stamp display page is illustrated in U.S. Pat. No. 4,356,649 issued Nov. 2, 1982, to Diamond, et al. for "Page Construction for a Stamp Album". It shows on its cover sheet a prior art page displaying three smaller stamps and one larger stamp and an alternative page showing spaces for four stamps. Cutouts and plastic strips are used in the page construction.

Another album page product is shown in U.S. Pat. No. 2,421,503 issued Jun. 3, 1947 to Hermon for "Visible Card, Photograph, and other Filing Sheets." Here a central opaque sheet is bounded on both sides by transparent sheets, which are cemented along the edges and in parallel, horizontal lines. Slits are provided to form pockets and channels are impressed into the sheets. The transparent material, slits and channels create pockets for receiving photographs and the slits on one side of the opaque sheet are aligned with the channels on the opposite side.

A display page for photographs, which includes space for memorandum descriptions, is shown in Beese French Patent No. 332,929 issued in 1903. Openings and slots are provided for display of pictures on either side of the sheet, and where two or more photographs are potentially able to contact one another in an album, an intermediate flyleaf is included. This patent, and a non-official translation thereof, are provided with the present application.

Another patent showing a page having room for the display of one or more photographs and accompanying data is shown in British Patent Specification No. 11,790 issued in 1894, a portion of which specification is supplied with this application. Such portion was obtained from the U.S. Patent Office prosecution history of the Ruebens patent discussed later herein.

A British Provisional Specification No. 29,275 dated in 1897, obtained from the same source described in the preceding paragraph, shows the use of a plurality of transparent strips, partially attached to an album page or sheet, to cover the objects to be displayed and to protect them.

A German Patent 534,428 issued in 1930, again obtained from the same source as the preceding foreign patents, shows a page having a first area for the display of a photograph and a second area in which descriptive matter may be provided.

Additional disclosures can be found in more recent U.S. patents. For example, U.S. Pat. No. 3,596,393 issued Aug. 3, 1971 to Lithgow, et al. and entitled "Device for the Housing and Storage of Microfilm" contains a rather specific disclosure of the use of two clear sheets, spot welded (or adhered) at spaced apart locations about the perimeter of the two superimposed sheets and at spaced apart internal locations, so that all of the welded spots are located in both a horizontal row and a vertical row. In use of the device, the microfilm strips can be inserted horizontally or vertically for display. One sheet may be larger than the other to provide an area for attaching the display to a file, or one sheet may be double the size of the other to fold thereover, creating a file.

U.S. Pat. No. 3,651,591 issued Mar. 28, 1972 to Woodyard for "Photo Album Page" describes a page which is opaque and which includes a series of clear strips adhered thereto along their bottom edges, their inner edges and at a plurality of locations along their top edges. Photographs may be inserted into the open ends of the resulting sleeves or between spaces in the top edges of the strips.

Yet a further prior art example is the "Card Negative Holder and Method of Manufacture" shown in U.S. Pat. No. 4,405,228 issued Sept. 30, 1983 to Muscoplat. In this device, which can be a book page, pressure-sensitive stock is used to hold negatives on a flat member, slits being provided for the insertion of negatives or the like. The flat member has a window through with the negative may be viewed.

U.S. Pat. No. 4,244,762, issued Jan. 13, 1981 to Holson and entitled "Heat Sealed Photo Album Page and Method of Making Same", and assigned to the assignee of the present invention, uses a fibrous, centrally disposed sheet and a pair of overlying clear synthetic resinous sheets. Pockets are formed by ultrasonic sealing of the clear sheets together through the fibrous sheet which disintegrates under the generated heat of sealing. Pockets are formed during a continuous sealing operation at the same time the page is laminated. The pockets are formed by sealing in broken lines, whereby the fibrous sheet retains structural integrity in some areas.

Another patent owned by the assignee of the present invention was issued on Apr. 12, 1994 to Hoffmeister. This U.S. Pat. No. 5,301,445 entitled "Album Page for Bi-Directional Insertion and Centering of Rectangular Images" includes a backing sheet and at least one pocket comprising a transparent sheet. The pocket is defined by attaching the backing sheet and the transparent sheet along the bottom and two opposed side edges and including two bracket seals, which extend upwardly from the bottom edge to retain an image in a fixed and centered position. The brackets are selected in height to permit either the vertical or horizontal display of similarly sized photographs which, in either case, are inserted from the top.

Two further prior art systems include the Wihlke U.S. Pat. No. 4,447,973 issued May 15, 1984 for "Album Leaf with Pockets for Insertion of Photographic Paper Prints and Similar Articles" and Ruebens U.S. Pat. No. 4,965,948 issued Oct. 30, 1990 for "Bi-Directional Album with Memo Area". In the former, a transparent sheet is welded to an opaque sheet along the edges and at various other horizontal and vertical locations to form pockets adapted to receive photographs. In one or more of the pockets, a single weld line extends from an edge by an amount which limits the orientation of a photograph to either a standing vertical orientation or a horizontally oriented position.

The Ruebens patent takes a somewhat different approach in providing a rectangular, opaque sheet which is bounded on both sides with transparent sheets narrower than the opaque sheet. The transparent sheets are each glued around the top, bottom and one side edge, corresponding to the outer vertical edge of the opaque sheet. This leaves the inner edge of each transparent sheet open along its entire length for the insertion of photographs. The patent also discloses the use of at least two, spaced-apart attachment lines extending from the outer, glued edge toward the inner non-attached edge, the distance being selected to permit horizontal insertion of pictures (i.e., between an upper or lower glue edge and one of the attachment lines or between a pair of the attachment lines) or the vertical insertion of one or more pictures (depending on the height of the page and the picture size) in such a manner that they lie entirely between the innermost ends of the attachment lines and the unattached edge of the transparent sheet.

Several drawbacks still exist with these various prior art album pages, some having to do with manufacturing, and some having to do with the finished article itself. One improvement over a number of such prior art systems has been practiced by the assignee of the present invention, namely the use of film-to-film sealing rather than the use of glue to adhere transparent sheets to the substrates. This has been accomplished by cutting out (for example using a die cutter) certain portions of the substrate and heat or sonic welding two transparent layers to one another at the location of the cut-outs. Not only is there a savings in adhesive purchases, the resulting film-to-film bond is stronger than the bond typically created between a film layer and a substrate using a liquid adhesive. The present assignees' prior device also permitted the use of a creased, cylindrical sleeve of clear plastic provided over the opaque sheet, eliminating high speed manufacturing problems with sheet alignment. Further, in a recent version of such sheet, horizontal, elongate cut-outs have been provided to permit the insertion of photographs along the left edge of a page in either horizontal or vertical alignments. Moreover, a small, cut-out at the center of the sheet provides additional stability when two photographs are inserted for display in a vertical orientation.

The elimination of the drawbacks of the prior art in an inexpensive, easy-to-assemble and aesthetically pleasing album page would represent a significant advance in this crowded and competitive field.

SUMMARY AND FEATURES OF THE INVENTION

A primary feature of the present invention is to provide an inexpensive, easy-to-manufacture and aesthetically pleasing album page which overcomes the above-noted disadvantages of prior album systems.

Another feature of the present invention is to provide an album page wherein all attachments of component parts are made using the same type of manufacturing operation, which preferably is heat or ultrasonic welding.

A different feature of the present invention is to provide an album page in which all components are securely attached together and which avoids the use of glue between clear plastic film layers and opaque substrate sheets.

A different feature of the present invention is to provide the capability, on a single page, of displaying a wide variety of photographs of different sizes in a variety of orientations, and when displaying objects horizontally on the sheet to adequately support both bottom corners of the object to maintain an aesthetically pleasing appearance and prevent skewing of the photograph or other displayed object, and when displaying photograph vertically to provide bottom support for each such photograph.

A still further feature of the invention is to provide top or side loading capabilities and a memo area readily receptive to most types of writing implements.

How these and other features of the present invention are accomplished is described in the following detailed description of the preferred embodiment of the invention, taken in conjunction with the drawings. Generally, however, they are accomplished in an album page construction including an opaque center sheet, which sheet may include memo areas, holes for inserting the page in an album and the like. Transparent material, preferably made from a thermoplastic resin, narrower than the page, is placed over the outer portions of the respective sides of the page. The center sheet includes a plurality of cut-out areas, so that the front sheet of transparent material is in proximity with its rear counterpart at the cutout areas. A seal is provided at each cut-out area to provide a film-to-film bond, e.g., by heat welding or sonic welding. Alternatively, if a thermoplastic material is also used for the center sheet, the cut-outs need not be made, and a three-layer heat weld can be made to accomplish the desired results. The sleeve is preferably not attached to the center sheet at any areas, except those where the heat or sonic welds are made, to facilitate the placement of objects, such as photographs, in a variety of orientations, and at least two welds are made at locations remote from the outer edges of the center sheet, so that support is provided for the two bottom corners of an object to be displayed in a horizontal orientation to prevent skewing thereof. In addition, thumbnail die cuts can be provided in the center sheet to form tabs to assist in supporting photographs displayed vertically. Other ways in which the objects of the present invention are accomplished will be described in the following specification or will become apparent to those skilled in the art after they have read this specification. Such other ways are deemed to fall within the scope of the present invention if they fall within the scope of the claims which follow.

BRIEF DESCRIPTION OF THE DRAWINGS

In the FIGS., like reference numerals are used for like components and

DETAILED DESCRIPTION OF THE PREFERRED AND ALTERNATE EMBODIMENTS OF THE INVENTION

Figure 1:
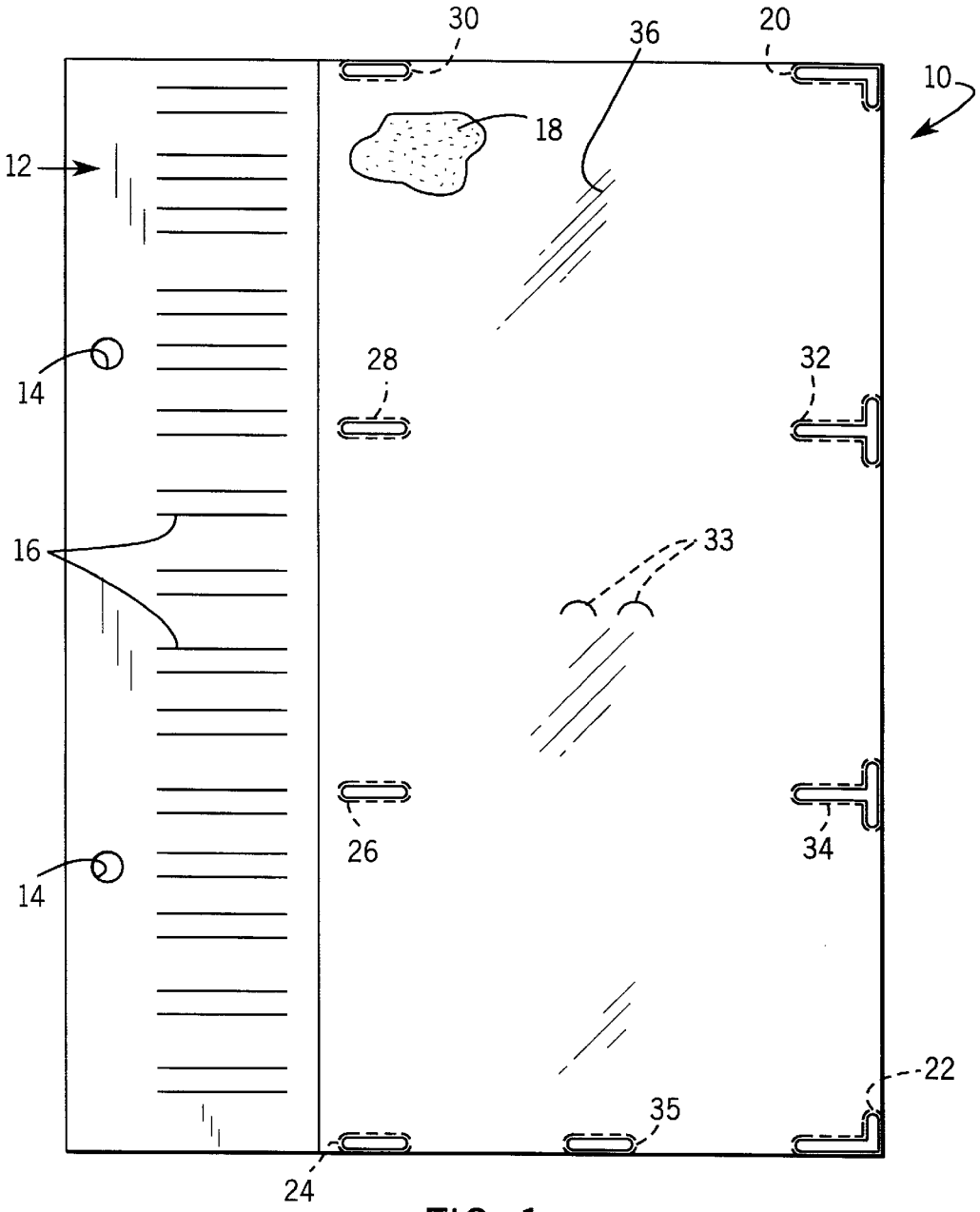
FIG. 1 is a front view of an album page according to a preferred embodiment of the present invention and illustrating several important features thereof.

Before proceeding to a detailed description of the invention and a description of the FIGS., several general comments can be made about the applicability and the scope of the invention.

First, while photographs are used to illustrate the type of objects which can be displayed using the album page of the invention, a variety of other planar objects could be substituted, such as paper sheets, cards, announcements, art work, memo slips, and the like.

Second, while an opaque fibrous (e.g. paper) center sheet is shown in the illustrations, the sheet may be of any material of any color, or may, for that matter, be clear. Likewise, the memo lines and contrasting background beneath the transparent sheets can be variously designed or eliminated altogether, depending on the aesthetic appearance determined for the particular end use by the page designer.

Third, ultrasonic welding is mentioned as the preferred technique to form film-to-film seals at various locations on the page, but heat welding using other well known film welding techniques would work in the present invention.

Fourth, die cuts or other openings are shown in the illustrated embodiment to allow high strength, film-to-film bonds when compared to film to paper adhesive bonds. However, two variations are deemed to fall within the scope of this invention, a first one of which is the use of adhesive for some, but not all of the bonds. The other alternative is the use of a film center sheet which itself can be heat or sonically welded to the transparent components to form tough film-to-film bonds, such as the center film sheets illustrated in the aforementioned Holson '762 patent. Such a film center sheet, other than its composition, can have all of the characteristics described above in the paragraph describing options for a center, fibrous sheet.

Fifth, certain dimensions are given in the drawings to illustrate various capabilities of the page of the present invention. However, these dimensions are exemplary only and the size of the pages themselves and the location and number of seals can be variously embodied. For example, instead of configuring the pages for use with 4×6 or 4×12 photographs, the page may be set up to accommodate 4×7 photographs or may be set up to hold larger or considerably smaller objects.

Finally, while the invention is primarily directed and is entitled "Album Page", the pages of the present invention need not contain any specific structure for inserting the pages in a book (such as holes or spiral binding openings), and the pages may be configured to have openings into the space between the transparent film and center sheet from both the right and left sides. This arrangement would be suitable, for example, if the page were to be used for evidence photographs and where the entire page might be inserted as a self-contained holder in a larger file.

Proceeding now to the description of FIG. 1, an album page 10 according to the most preferred embodiment of the present invention is shown. It includes a center opaque sheet 12, which may be paper, such as a white paper having a weight typical of that used in the photo album art, e.g. paper having a weight of about between 10 pounds to 50 pounds per 1,000 square feet. Holes 14 are provided adjacent the left side of sheet 12 for inserting the album page into a ring binder or the like. In the illustrated embodiment, a plurality of memo lines 16 are printed along the left side of sheet 12 from the top to the bottom and a contrasting pattern, illustrated in the area designated 18 is printed over the remainder of sheet 12 and to the right of the memo lines 16. The particular colors, contrast and pattern may be variously embodied as previously indicated.

Sheet 12 also includes a plurality of cut-out portions which will be identified beginning with the cut-out portion at the upper right hand corner of the sheet 12 as illustrated. At that corner, an L-shaped cut-out 20 is provided and extends approximately 1" across the top of sheet 12 and approximately ½" down the right side. A similar, L-shaped cut-out 22 is provided at the bottom right corner. A series of cut-outs which are linear, and horizontal of approximately 1" in length, are provided along the left margin of the patterned area 18 including a first such cut-out 24 at the bottom of the page, a second cut-out 26 approximately ⅓ of the way to the top, a second intermediate cut-out portion 28 approximately ⅔ of the way to the top, and a cut-out 30 at the top of sheet 12. A small cut-out, linear and approximately ½" in length, shown at reference numeral 35, is located approximately half way between cut-outs 22 and 24.

Two T-shaped cut-outs are provided along the right edge of sheet 12. These cut-outs include a base for the T of about 1½" in length, while the top of the T is about 1" in length. The tops of the T's lie along the right edge of sheet 12. The first of such T-shaped cut-outs 32 is located so that its base is aligned with cut-out 28 but spaced apart therefrom, while the second T-shaped cut-out 34 is arranged so that its base is co-linear and aligned with cut-out 26, but spaced apart therefrom.

Finally, a pair of adjacent semi-circular cuts are provided near the center of sheet 12 to form a pair of tabs 33, the purpose of which will be explained later.

Figure 1A:
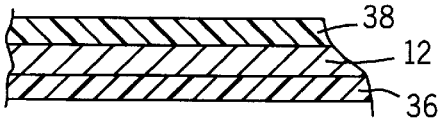
FIG. 1A is a schematic representation of the three layers of a typical page such as the one shown in FIG. 1.
Figure 1B:
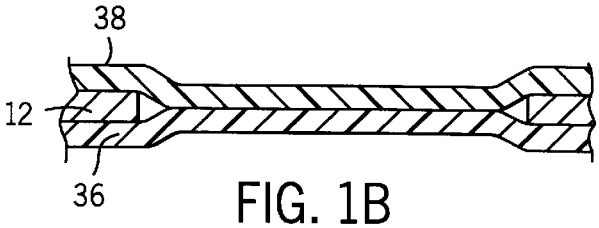
FIG. 1B is a schematic representation of a section of the page shown in FIG. 1, and illustrating the welding of two plastic sheets to one another in an area where no center sheet material exists.

Sheet 12, in the most preferred embodiment is covered on its front and back by transparent outer sheets 36 and 38. Transparent sheet 36 covers the patterned portion 18 of the front of sheet 12, while transparent sheet 38 covers the patterned portion on the rear side. The sheets 36 and 38 have a length identical to that of sheet 12 and a width sufficient to extend from the right edge of sheet 12 to the left margin of the patterned area 18 and hence the left margin of cut-outs 24, 26, 28 and 30. FIG. 1A schematically illustrates the three layers of material which are used to comprise album page 12 in an area where all three components exist. If such a sectional view were taken through any area represented by one of the enumerated cut-outs, the center sheet 12 would not be present, thereby permitting the sheets 36 and 38 to directly confront one another. This situation is illustrated schematically in FIG. 1B.

When assembled, sheets 36 and 38 are heat welded or ultrasonically sealed by heat to each other at each of the enumerated cut-outs. The sonic welding may be by spot welding, as is known is the ultrasonic welding art.

Preferred materials for sheets 36 and 38 are those thermoplastic materials which can be heated and welded to one other including polyesters, polyethylene, polypropylene, polycarbonates or any other heat weldable plastic sheet material known for use in the photo album sheet art. Ultrasonic stitching of such plastic sheets is discussed in several of the prior art references described above.

Figure 2:
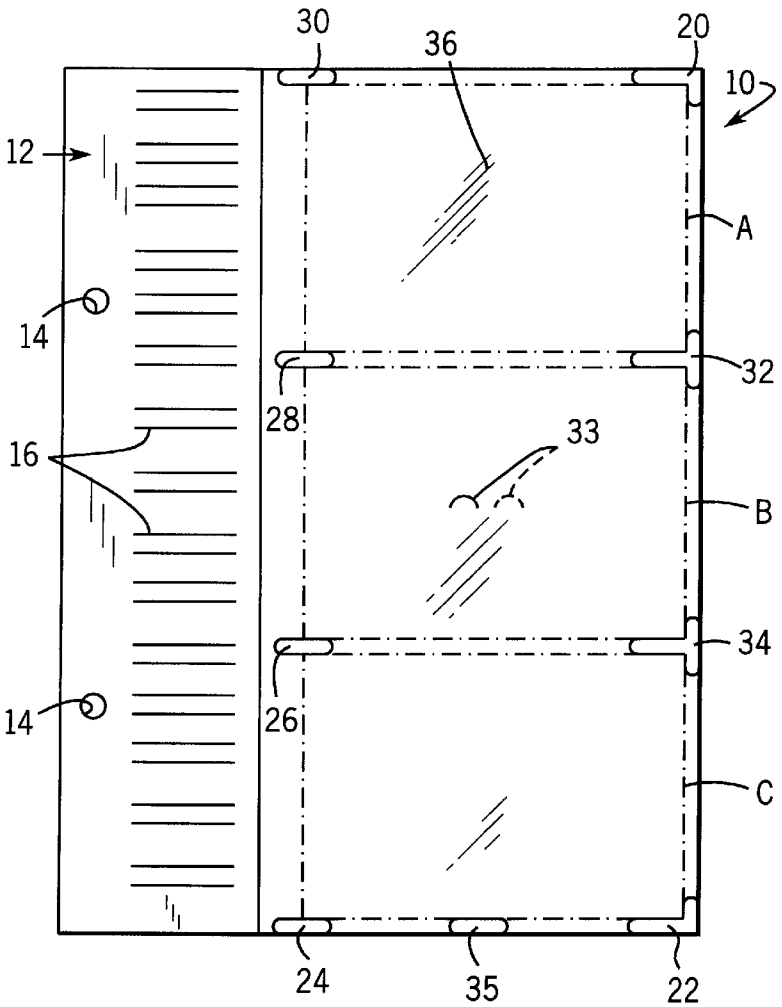
FIG. 2 is a front view of the page shown in FIG. 1 and illustrating the horizontal placement of three, like-sized photographs.

FIG. 2 illustrates the page 10 shown in FIG. 1, together with three 4×6 objects, which for purposes of this description, are photographs A, B and C. In this illustration, each of the photographs is mounted horizontally, i.e. with its long direction parallel to the top and bottom of sheet 12. Photograph A is inserted between seal areas 28 and 30, and photograph A is confined by the angled seals formed at corner 20 and at cut-out 32. Photographs B and C are similarly inserted from the left side of sheet 36 and are supported by at least two, spaced-apart seal areas. This will ensure a pleasing, aesthetic presentation of the photographs and prevent skewing of the photographs from the illustrated position.

Figure 3:
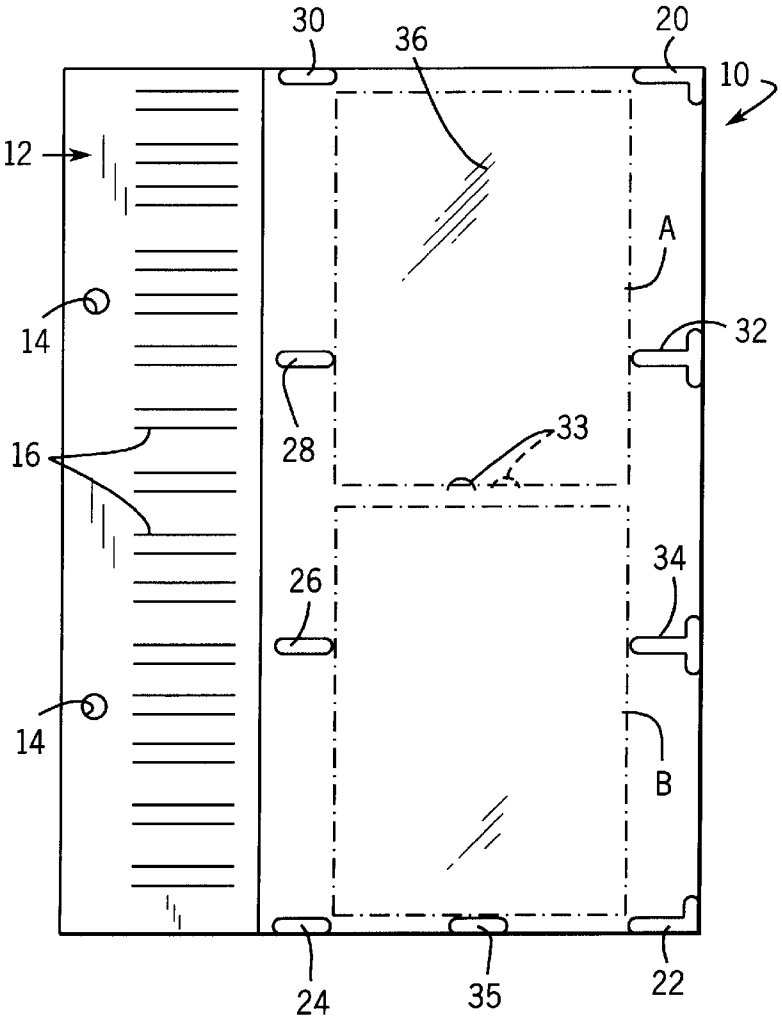
FIG. 3 is a front view of the page shown in FIG. 1 and illustrating the vertical placement of two, like-sized photographs.

FIG. 3 shows the vertical display of two photographs, A and B, using the sheet 10 of the present invention, each being inserted beneath sheet 36 between the cut-outs 30 and 20 and each being spaced from the side edges of sheet 36 by the cut-outs 28–32 and 26–34. The bottom of photograph B is supported by the cut-out and seal area at 35 and the bottom of photograph A is supported by one of the tabs 33. The other tab 33 could be used for support of a vertically arranged photograph on the reverse side of album sheet 10.

Figure 4:
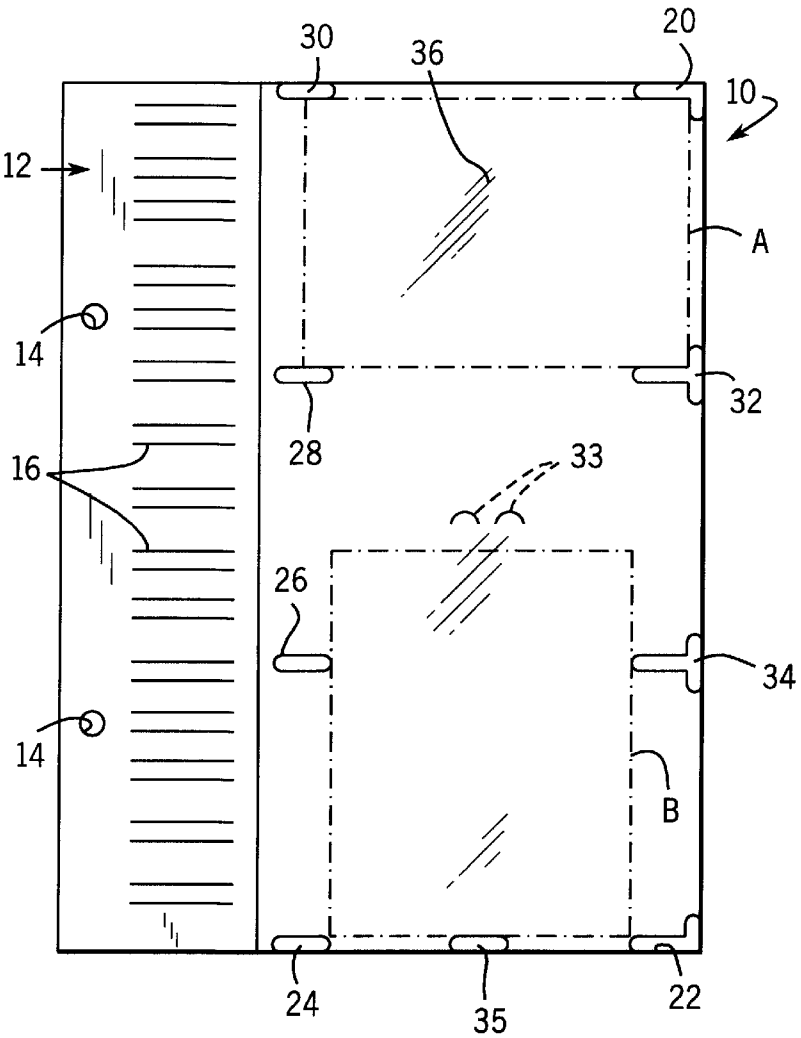
FIG. 4 is a front view of the page shown in FIG. 1 and illustrating the horizontal placement of one photograph and the vertical placement of another like-sized photograph.

Another arrangement is shown in FIG. 4 where photograph A is displayed in a horizontal position in an identical manner as shown in FIG. 2, while photograph B is displayed vertically in the same manner as illustrated in FIG. 3. Note that photograph A is prevented from skewing by the cut-out and seal areas 28 and 32, while photograph B is maintained in its desired position by cut-out and seal areas 26, 34 and 35.

Figure 5:
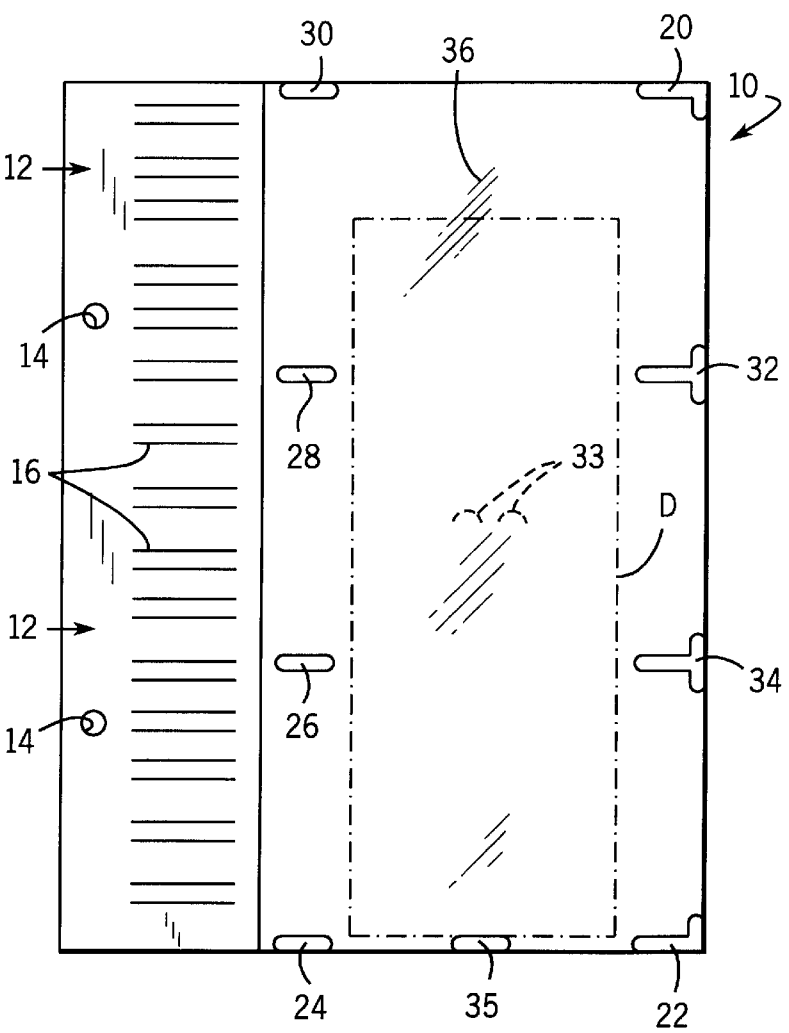
FIG. 5 is a front view of the page shown in FIG. 1 illustrating the vertical placement of a single photograph having a length equal to twice that of the photograph shown in the other FIGS.

A final arrangement is illustrated in FIG. 5 where one large photograph D, having dimensions of 4"×12", is inserted from the top of sheet 10 between cut-out and seal areas 30 and 20 and is supported between the cut-out and seal areas 26, 28, 32, 34 and bottom seal area 35. Such photographs are becoming more popular with the development and sale of panoramic camera systems.

As will be readily apparent, the opposite side of the page 10 may support photographs A, B, C or D in the same variety of arrangements as has been illustrated in FIGS. 2–5 or such photographs may be differently arranged from the array on the front of a page 10. Moreover, it bears repeating here that the cut-outs referred to in the FIGS. can be eliminated by using plastic center sheets and forming three layer seal areas at the same locations as described for the cut-out areas shown. So while the present invention has been illustrated with reference to certain embodiments, it is not to be limited thereto, but is to be limited solely by the scope of the claims which follow.

What is claimed is:

1. A page for displaying planar objects comprising:

a center sheet;

a first and a second plastic sheet on the front and the back of the center sheet, wherein the center sheet is rectangular having a top edge, a bottom edge and opposed side edges, the first and second plastic sheets are rectangular and have a top edge, a bottom edge and opposed side edges, the top, bottom and at least one side edge of the plastic sheets adjoining the top, bottom and at least one side edge of the center sheet;

a plurality of spaced apart seals joining the sheets at locations selected for permitting the display of planar objects between the first sheet and the center sheet and between the center sheet and the back sheet, said plurality of seals including at least one pair of spaced apart seals arranged to support a bottom edge of a planar object and prevent skewing thereof, and at least one of said plurality of seals is a heat seal of one plastic sheet to another plastic sheet; and cut-out portions are provided at the bottom and top corners of the center sheet at each side thereof where the first and second plastic sheets adjoin the center sheet, at a plurality of spaced apart locations along the bottom edge where the sheets adjoin one another, and wherein a pair of bottom edge supporting seals is located intermediate the bottom and top edges of the adjoining sheets.

2. The page of claim 1 wherein said center sheet is a paper sheet having a plurality of cut-out portions located at areas where seals join sheets and at least one of the heat seals is located at such cut-out portion between the first and second plastic sheets.

3. The page of claim 1 wherein the bottom edge supporting seals are heat seals and cut-outs of the center sheet are provided at the location of each such bottom edge supporting seal.

4. The page of claim 3 wherein the corner cut-out portions are L-shaped, the bottom edge cut-out portions are elongate and linear, and wherein each pair of spaced apart bottom edge seals is provided through a pair of cut-out portions, one of which is T-shaped with the top of the T lying along a side edge of the sheets and the base of the T extends perpendicularly therefrom toward the other side, and the other of which is an elongate linear cut-out, the base of the T and the other elongate linear cut-out being co-linear but spaced apart from one another.

5. The page of claim 4 wherein at least two pairs of bottom edge supporting seals are formed intermediate the bottom and top edges of the adjoining sheets.

6. The page of claim 4 wherein the two bottom edge supporting seals are spaced apart from one another by a distance sufficient to permit a planar object to be disposed therebetween.

7. The page of claim 4 wherein at least one semi-circular cut is provided in the center sheet for creating a tab to support an edge of a planar object.

8. The page of claim 3 wherein the planar objects to be displayed are rectangular and have a width greater than their height, the distance between the spaced apart bottom supporting seals being greater than the height of the object but less than the width thereof.

9. The page of claim 1 wherein each seal is a heat seal of one plastic sheet to another plastic sheet.

10. The page of claim 1 wherein the center sheet is a paper sheet and cut-out portions are provided at each seal location and wherein each seal is a heat seal of the first plastic sheet to the second plastic sheet.

11. The page of claim 1 wherein the center sheet is a thermoplastic sheet and each heat seal bonds the three sheets to one another.

12. The page of claim 11 wherein every seal is a heat seal bonding the three sheets to one another.

13. The page of claim 1 wherein each heat seal is made by heat welding one plastic sheet to another plastic sheet.

14. The page of claim 1 wherein the two bottom edge supporting seals are spaced apart from one another by a distance sufficient to permit a planar object to be disposed therebetween.

15. The page of claim 1 wherein at least one semi-circular cut is provided in the center sheet for providing a tab for the support of an edge of a planar object.

16. The page of claim 1 wherein the planar objects to be displayed are rectangular and have a width greater than their height, the distance between the spaced apart bottom supporting seals being greater than the height of the object but less than the width thereof.

17. The page of claim 16 wherein a semi-circular cut is provided in the center sheet to provide a tab to support an edge of a planar object placed between the bottom supporting seals.

18. A photo album page having a top, a bottom and side edges for supporting a plurality of rectangular photographs having two longer sides and two shorter sided and providing the capability of displaying the photographs in either a vertical position in which the longer sides are parallel to the side edges of the page or a horizontal position in which the longer sides are perpendicular to the side edges of the page, the improvement comprising:

a center sheet for the page and a pair of transparent, thermoplastic sheets on either side thereof, the sheets being adhered to one another by a plurality of seals, at least one of such seals being a thermoplastic film-to-thermoplastic film seal and the page including at least one pair of spaced apart seals arranged for supporting the bottom of a photograph in a horizontal position, the distance between the bottom supporting seals being greater than the distance between the longer sides of the photograph to be displayed and less than the distance between the shorter sides of the photograph to be displayed, the bottom supporting seals being arranged so that a line extending therebetween would be perpendicular to the side edges of the page; and cut-out portions are provided at the bottom and top corners of the center sheet at each side thereof where the first and second thermoplastic sheets adjoin the center sheet, at a plurality of spaced apart locations along the bottom edge where the sheets adjoin one another, and wherein a pair of bottom edge supporting spaced seals is located intermediate the bottom and top edges of the adjoining sheets.

19. The page of claim 18 wherein said center sheet is a paper sheet having a plurality of cut-out portions located at areas where seals join the thermoplastic sheets and at least one of the heat seals is located at such cut-out portion between the first and second thermoplastic sheets.

20. The page of claim 18 wherein the bottom edge supporting seals are heat seals and cut-out portions of the center sheet are provided at the location of each such bottom edge supporting seal.

21. The page of claim 20 wherein each seal is a heat seal of one thermoplastic sheet to another thermoplastic sheet.

22. The page of claim 21 wherein the center sheet is a paper sheet and cut-out portions are provided at each seal location and wherein each seal is a heat seal of the first thermoplastic sheet to the second thermoplastic sheet.

23. The page of claim 18 wherein the center sheet is a thermoplastic sheet and each heat seal bonds the three sheets to one another.

24. The page of claim 23 wherein every seal is a heat seal bonding the three sheets to one another.

25. The page of claim 23 further including a semi-circular cut made in the center sheet forming a tab for supporting a bottom edge of a photograph displayed between the bottom edge supporting seals.

26. The page of claim 18 wherein each heat seal is made by heat welding one thermoplastic sheet to another thermoplastic sheet.

27. The page of claim 18 wherein the corner cut-out portions are L-shaped, the bottom edge cut-out portions are elongate and linear, and wherein each pair of spaced apart bottom edge supporting seals is provided by a pair of cut-out portions, a first one of which is T-shaped with the top of the T lying along a side edge of the sheets where the sheets adjoin one another and the base of the T extends perpendicularly therefrom toward the other side and the other of which is an elongate linear cut-out, the base of the T and the other elongate linear cut-out being co-linear but spaced apart from one another.

28. The page of claim 27 wherein at least two pairs of bottom edge supporting seals are formed intermediate the bottom and top edges of the adjoining sheets.

* * * * *